US006114997A

United States Patent [19]

Lee et al.

[11] Patent Number: 6,114,997

[45] Date of Patent: Sep. 5, 2000

[54] LOW-PROFILE, INTEGRATED RADIATOR TILES FOR WIDEBAND, DUAL-LINEAR AND CIRCULAR-POLARIZED PHASED ARRAY APPLICATIONS

[75] Inventors: Kuan M. Lee, Brea; Allen T. S. Wang, Buena Park; Loc Chau, Canoga Park, all of Calif.

[73] Assignee: Raytheon Company, Lexington, Mass.

[21] Appl. No.: 09/085,157

[22] Filed: May 27, 1998

[51] Int. Cl.[7] ..... H01Q 1/38

[52] U.S. Cl. ..... 343/700 MS; 343/846; 343/853

[58] Field of Search ..... 343/700 MS, 846, 343/848, 829, 830, 853, 778; H01Q 1/38

[56] References Cited

U.S. PATENT DOCUMENTS 5,745,079 4/1998 Wang et al. ..... 343/700 MS 5,880,694 3/1999 Wang et al. ..... 343/700 MS

FOREIGN PATENT DOCUMENTS

0521384 A 7/1993 European Pat. Off. .

2261118 A 5/1993 United Kingdom .

*Primary Examiner*—Michael C. Wimer

*Attorney, Agent, or Firm*—Leonard A. Alkov; Glenn H. Lenzen, Jr.

[57] ABSTRACT

A planar, low-profile, very wide frequency bandwidth, wide-scan, dual-linear or circular-polarized phased array antenna using integrated stacked-disc radiator tiles. The stacked-disc radiator configuration comprises a lower active radiator fed by a pair of probes for each polarization state, and a parasitic radiator separated from the active radiator by dielectric material. The stacked-disc radiator is integrated with its multi-layer feed circuits in a very compact package. The feed circuits include 90° hybrid coupler circuits and 180° hybrid coupler circuits that couple dual linear or dual circular polarized energy to and from the disk radiators.

20 Claims, 6 Drawing Sheets

Fig. 1
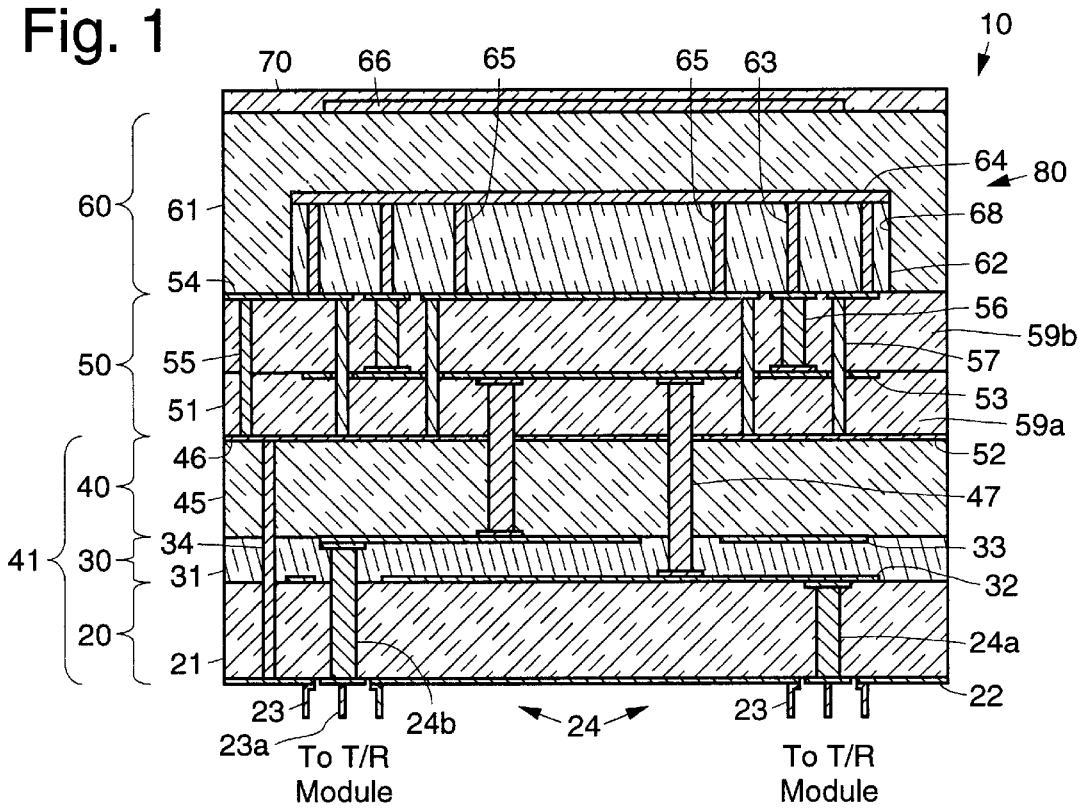
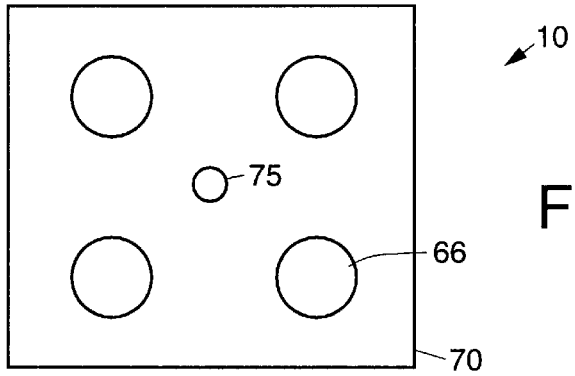
Fig. 2a
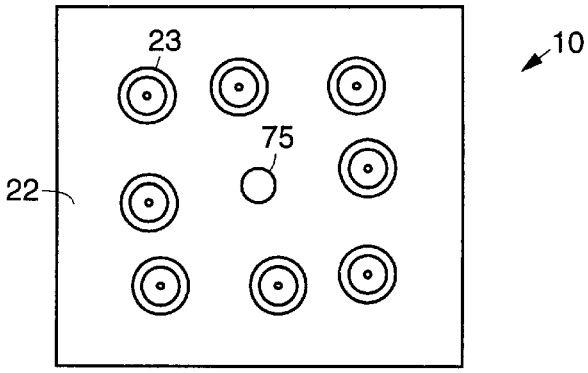
Fig. 2b

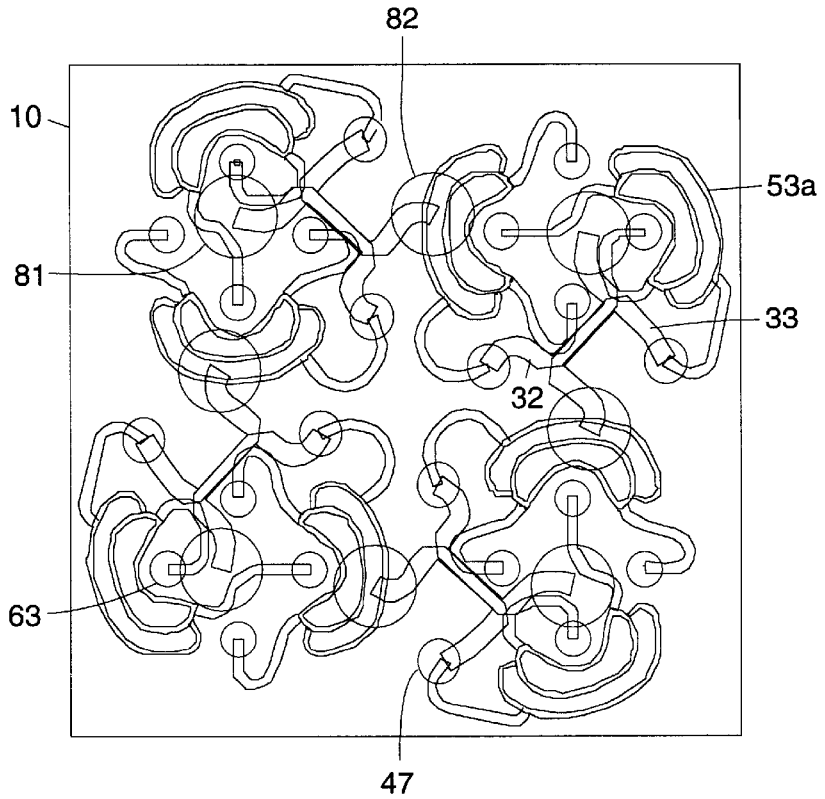
Fig. 5
Fig. 6
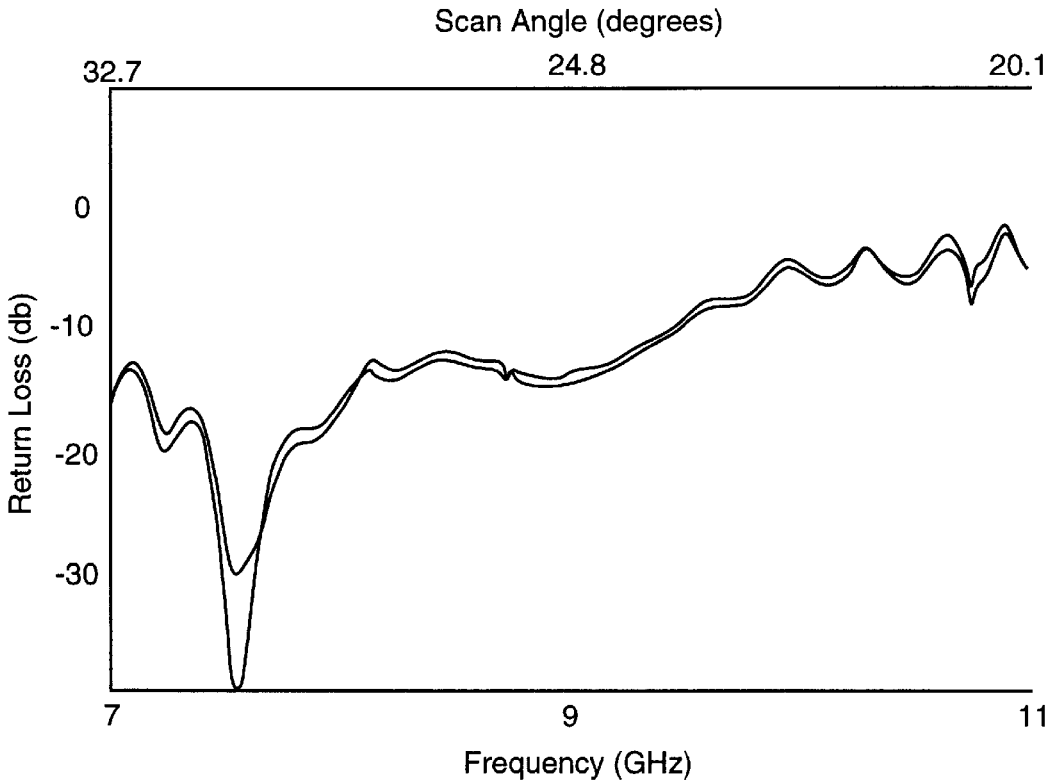

LOW-PROFILE, INTEGRATED RADIATOR TILES FOR WIDEBAND, DUAL-LINEAR AND CIRCULAR-POLARIZED PHASED ARRAY APPLICATIONS

BACKGROUND

The present invention relates generally to phased array antennas, and more particularly, to planar, low profile phased array antennas employing stacked disc radiators.

The assignee of the present invention has investigated the development of super high frequency phased array antennas for use in various radar and communication applications. Typical applications for such super high frequency phased array antennas include submarine communication systems, ground-based communication systems, radar systems, and satellite communication systems, and the like.

To this end, the assignee of the present invention has developed several phased array antennas using disc radiator apertures. U.S. Pat. No. 5,745,079, issued Apr. 28, 1998, entitled "Wide-Scan/Dual-Band stacked disc radiators on stacked dielectric posts phased array antenna", provides for an antenna that exhibits performance over an octave-bandwidth. U.S. patent application Ser. No. 08/878,171, filed Jun. 18, 1997 entitled "Planar, Low Profile, Wide-Band, Wide Scan Phased Array Antenna Using a Stacked-Disc Radiator", now U.S. Pat. No. 5,880,694, provides for an antenna that exhibits excellent performance while maintaining a planar, low profile.

Papers have also been published that address prior developments leading up to the present invention. A publication in the 1996 IEEE AP-S International Symposium, Baltimore, Md., pp. 1150–1153, entitled "Low-Profile, Broadband, Wide-Scan, Circular-Polarized Phased Array Radiator", discusses the subject matter contained in U.S. Pat. No. 5,745,079. Another publication in the 1997 IEEE AP-S International Symposium, Montreal, Canada, pp. 702–704, entitled "Planar, Low Profile, Wideband, Wide-Scan Phased Array Antenna Using Stacked-Disc Radiator", discusses the subject matter contained in U.S. Pat. No. 5,880,694. The present invention is an improvement to the invention disclosed in U.S. Pat. No. 5,880,694. It would therefore be advantageous to have an improved antenna element that permits the construction of planar, low profile, wide-band, wide scan phased array antennas.

Accordingly, it is an objective of the present invention to provide for an improved antenna element that may be used to construct planar, low profile phased array antennas. It is a further objective of the present invention to provide for an improved antenna employing compact stacked disc radiator elements.

SUMMARY OF THE INVENTION

To meet the above and other objectives, the present invention provides for a versatile planar, low-profile, very wide frequency bandwidth, wide-scan, circular-polarized phased array antenna using integrated radiator tiles comprising stacked-disc radiators. The present invention comprises a stacked-disc radiator configuration where a lower active radiator is fed by a pair of probes for each linear polarization, and a parasitic radiator separated from the active radiator by dielectric material. The stacked-disc radiator is integrated with its feed circuits in a very compact and versatile package. The integration of the stacked disc radiator and its compact multi-layer feed circuits are described herein. The feed circuits may include power combiners, 90° hybrid coupler circuits and 180° hybrid coupler circuits that couple dual linear or dual circular polarized energy to and from the disk radiators.

The present invention may be employed in ground-based, shipboard, airborne, and radar and satellite communication systems that operate using wide-band, wide-scan phased array antennas with dual linear or dual circular polarization. The integrated stacked-disc radiator tiles are ideal for use in conformal phased array antenna applications. In addition to providing wide-band and wide scan performance, the integrated radiator tiles are planar, low profile, and light weight, can be produced inexpensively using printed circuit technology, and its form factor allows the arrays to be easily maintained. In general, the integrated radiator tile lends itself well to many conformal applications and tile array architectures.

The present invention integrates the radiator (stacked-disc radiator) with its feed circuits. The resulting package, or integrated radiator tile, is very wideband (45% bandwidth) and provides a wide-scan and good axial ratio (circular polarization purity). The design of the integrated radiator tile provides for polarization diversity. Thus, changing feed circuits can provide, linear, dual-linear, and dual-circular polarization capability.

The packaging of the integrated radiator tile is compactly constructed using multilayer laminated printed circuit technology. Thus, the integrated radiator tiles can be inexpensively constructed. The dielectric materials that are laminated to produce the multilayer integrated radiator tile have comparable coefficients of thermal expansion. Furthermore, use of the integrated radiator tiles of the present invention greatly improves the assembly and maintainability of phased array antennas that employ them.

The feed circuits and number of circuit layers in the integrated radiator tile are a function of the application in which the tile is used. These aspects change depending on whether the tile has a linear or circular polarized configuration, whether the stacked disk radiator can be block-fed, whether the design requires an external coaxial connector, and so on. The stacked-disc radiator can provide an octave bandwidth. The feed circuits that drive the stacked-disc radiator provide a means to achieve this octave bandwidth. The integrated radiator tile uses wideband feed circuits that are compactly constructed and that are integrated with the stacked disc radiator in an low-cost package. The bandwidth of the feed circuits and vertical RF transitions essentially determine the overall bandwidth performance of the integrated radiator tile. Integrated radiator tiles have been constructed that can cover 45% bandwidth.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which FIG. 1 shows an enlarged partial cross-sectional view of a portion of an integrated radiator tile in accordance with the principles of the present invention that illustrates its multilayer construction;

FIG. 2*a* illustrates an enlarged top view of the integrated radiator tile of FIG. 1;

FIG. 2*b* illustrates an enlarged bottom view of the integrated radiator tile of FIG. 1;

FIG. 5 illustrates the stacked disc radiator feed layout used in the integrated radiator tile of FIG. 1, showing superimposed internal circuit layers;

FIG. 6 shows a waveguide simulator measurement for the integrated radiator tile of FIG. 1;

DETAILED DESCRIPTION

Figure 4:
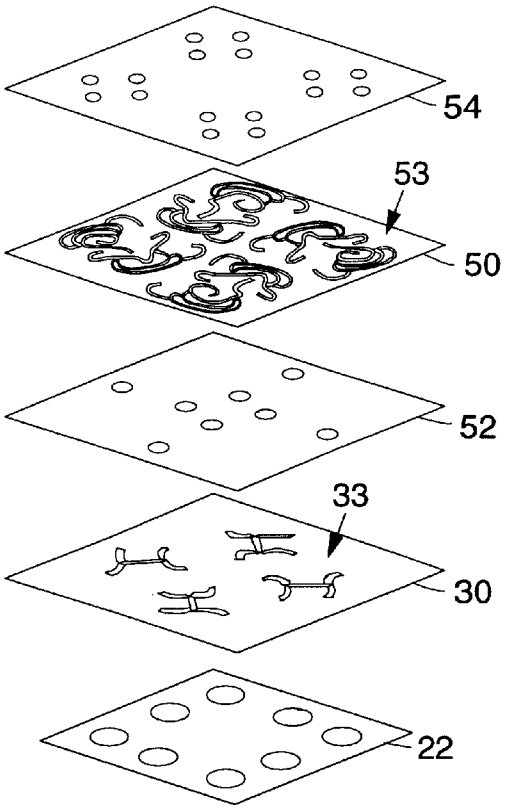
FIG. 4 illustrates an exploded view of the multilayer feed circuit structure used in the integrated radiator tile of FIG. 1.

Referring to the drawing figures, FIG. 1 shows an enlarged partial cross-sectional view of a portion of an integrated radiator tile 10 in accordance with the principles of the present invention and which illustrates its multi-layer construction. The integrated radiator tile 10 includes a stripline circuit board 41 having a bottom dielectric layer 20 comprising dielectric material 21 having a dielectric constant of 3.27, for example, and having a conductive ground plane 22 disposed on an exposed surface thereof. First and second coaxial connectors 23 (such as commercial SSMP coaxial connectors 23, for example) are attached to the ground plane 22 by means of solder, for example, and have center pins 23*a* connected to conductive vias 24 formed through the bottom dielectric layer 20 that each comprise stripline to coaxial transitions 24 in the exemplary embodiment. Alternatively, a connectorless design is also possible by having a coax-like structure (including either fuzz-button or pin, with outer dielectric shell) coming from below and making direct contact to RF vias 24.

A 90° coupling circuit layer 31 is attached to the top dielectric layer 20. The coupling circuit layer 31 comprises bottom and top circuits 32, 33 formed on opposite sides of a dielectric layer 31. The bottom and top circuits 32, 33 comprise a middle layer of the 90° coupler circuit layer 31. A first vertical transitions 24*a* connects the bottom RF trace 32 to one coaxial connector 23 through the bottom dielectric layer 20. The other of the RF trace 33 connects to the other coaxial connector 23 through the bottom dielectric layer 20 and middle dielectric layer 31 by way of a second vertical RF transition 24*b*. The vertical transitions 24*a*, 24*b* are substantially perpendicular to the stripline circuit board 41, which helps to produce a compact low profile design.

The stripline circuit board 41 comprises an intermediate dielectric layer 40 made of dielectric material 45 having a dielectric constant of 3.4, for example, that is disposed between the coupling circuit layer 30 and a balun layer 50. The balun layer 50 has a lower ground plane 52 formed on a surface that is adjacent to the intermediate dielectric layer 40, and an upper ground plane 54 that is formed on its upper surface. The balun layer 50 is comprised of two dielectric boards. One of the dielectric boards 59*a* has a bottom ground plane 52. The other dielectric board 59*b* has a top ground plane 54. A plurality of grounding vias 55 are coupled between the lower and upper ground planes 52, 54 of the balun layer 50 and also around the RF vias (i.e., vias 24*a*, 47, 56, or 63). The plurality of grounding vias 55 function to provide a coax-like cross-section at the transition and to prevent the excitation of higher-order modes. A plurality of grounding vias 34 are also coupled between the lower ground plane 52 of the balun layer 50 and the bottom ground plane 22 disposed on the exposed surface of the bottom dielectric layer 20. The plurality of grounding vias 34 serve the same function as the vias 55 relative to layer 50. The locations of the grounding vias 55 are shown more clearly in FIG. 5*a*.

The balun layer 50 comprises 180° hybrid coupler circuits 53 that are implemented using modified ratrace couplers 53*a*. The balun layer 50 has an upper ground plane 54 formed adjacent to an surface. A plurality of RF transitions 47 are coupled between the balun layer 50 and the respective bottom and top stripline circuits 32, 33. The transitions 47 are in the form of vertical transitions which are perpendicular to the stripline circuit board. A plurality of RF transitions 56 are coupled between the 180° hybrid coupler circuits 53 and the upper surface of the balun layer 50. A plurality of ground vias 57 surround each of the radiator to RF transitions 56 that extend from the upper ground plane 54 to the lower ground plane 52.

An upper dielectric layer 60 comprising a relatively low dielectric constant material is disposed adjacent to the balun layer 50. The dielectric constant of the upper dielectric layer 60 is typically on the order of 1.7, for example. Emerson & Cuming Stycast material may be used as the upper dielectric layer 60. The upper dielectric layer 60 may be made of a low-dielectric constant foam material.

In a preferred embodiment, the upper dielectric layer 60 has a plurality of cylindrical recesses 68 formed therein into which a plurality of dielectric pucks 62 are disposed. The dielectric pucks 62 may be formed using Rogers TMM 3 dielectric material having a dielectric constant of 3.27, for example. Disposing the dielectric pucks 62 in the recesses 68 reduces the overall thickness of the integrated radiator tile 10. However, it is to be understood that the dielectric pucks 62 need not be disposed in the recesses 68 and surrounded by dielectric material, but may be surrounded entirely or partially by air dielectric for example.

The dielectric pucks 62 have an active radiator 64 formed on their upper surfaces. The plurality of probes 63, comprising metallized vias 63, formed through the dielectric pucks 62 are coupled at one end to the active radiator 64. The plurality of radiator to stripline transitions 56 are coupled between the 180° hybrid coupler circuits 53 and the probes 63. The dielectric puck 62 is surrounded by dielectric material 61 having a dielectric constant of about 1.70.

A parasitic radiator 66, or parasitic patch 66, is disposed on an upper surface of the upper dielectric layer 60. The parasitic radiator 66 is separated from the active radiator 64 by dielectric material 61. The active radiator 64, the parasitic radiator 66, the dielectric puck 62, and the low-electric constant upper dielectric layer 60 form a stacked-disc radiator 80. A radome layer 70 is disposed over the upper surface of the upper dielectric layer 60 and the parasitic radiator 66 to provide protection from the environment and improve the impedance match. A flat foam spacer may be disposed between dielectric puck 62 and the radome 70. A plurality of metallized vias 65 surround each of the probes 63 which function to control the radiating pattern of the stacked-disc radiator 80.

Thus, in the exemplary embodiment of the present invention, the stacked-disc radiator 80 is disposed over two laminated stripline circuit boards containing the 90° hybrid coupler circuits 41 and the 180° hybrid coupler circuits 50. The topmost stripline circuit board is the balun layer 50 containing the 180° hybrid coupler circuits 53 and the lower stripline circuit board is the coupling circuit layer 41 containing the 90° hybrid coupler circuits 32, 33. However, it is to be understood that more than two laminated stripline circuit boards may be employed, depending upon the application.

FIG. 2*a* illustrates an enlarged top view and FIG. 2*b* illustrates an enlarged bottom view of the integrated radiator tile 10 of FIG. 1, respectively. FIG. 2*a* shows the relative positions of each of the parasitic patches 66 covered by the radome layer 70. The locations of the coaxial connectors 23 on the bottom surface of the integrated radiator tile 10 is shown in FIG. 2*b*. A central through hole 75 is disposed through the integrated radiator tile 10 that is used to secure the tile 10 and is shown in both FIGS. 2*a* and 2*b*. Invention is not limited to a 2×2 tile, could be any size.

Multiple feed circuits may also be implemented, as in the case where the radiators are block-fed. The figure shows a 2×2 tile. The plurality of radiators on a tile depends on fabrication yield as well as specific application requirements. It is also possible to have designs without coaxial connectors 23.

Figure 3:
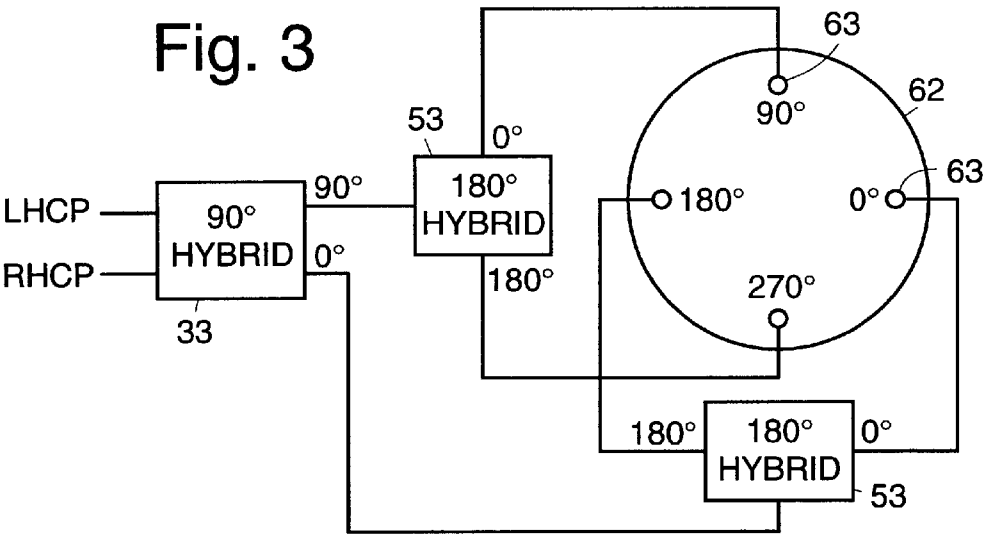
FIG. 3 illustrates a feeding arrangement for achieving dual circular polarization using the integrated radiator tile of FIG. 1.

FIG. 3 illustrates a feeding arrangement for achieving dual circular polarization using the integrated radiator tile 10 of FIG. 1. Metallized vias 63 serve as the probes 63 for the stacked-disc radiator 80 and vias 24, 47, 56 (shown in FIG. 1) serve as vertical RF interconnects between the various feed layers.

The feeding arrangement produces both senses of circular polarization. The four probes 63 of each integrated radiator tile 10 are excited in phase sequence in the manner shown in FIG. 3. This may be achieved by feeding two orthogonal pairs of probes 63 using two 180° hybrid coupler circuits 53 and combining the outputs with a 90° hybrid coupler circuit 33.

More specifically, the 90° hybrid coupler circuit 33 receives left hand circularly polarized (LHCP) and right hand circularly polarized (RHCP) excitation signals. In transmit mode, 0° and 90° outputs of the 90° hybrid coupler circuit 33 are coupled to first and second 180° hybrid coupler circuits 53, respectively. The 0° output of the 90° hybrid coupler circuit 33 feeds the first 180° hybrid coupler circuit 53, while the 90° output of the 90° hybrid coupler circuit 33 feeds the second 180° hybrid coupler circuit 53. 0° and 180° outputs of the first 180° hybrid coupler circuit 53 are coupled to probes 63 located at 0° and 180°, respectively. 0° and 180° outputs of the second 180° hybrid coupler circuit 53 are coupled to probes 63 located at 90° and 270°, respectively. Dual linear polarization can also be easily attained by removing the 90° hybrid coupler (hence layer 41) and taking the outputs signals of 57.

FIG. 4 shows an exploded view of the multilayer feed circuit structure used in the integrated radiator tile 10 of FIG. 1. Selected layers are shown without having apparent thickness and illustrate surface features thereof. FIG. 4 shows the radiator tile is constructed as a multilayer laminated structure. Its dielectric materials are carefully chosen to have comparable coefficients of thermal expansion to ensure successful lamination of the boards.

Figure 5A:
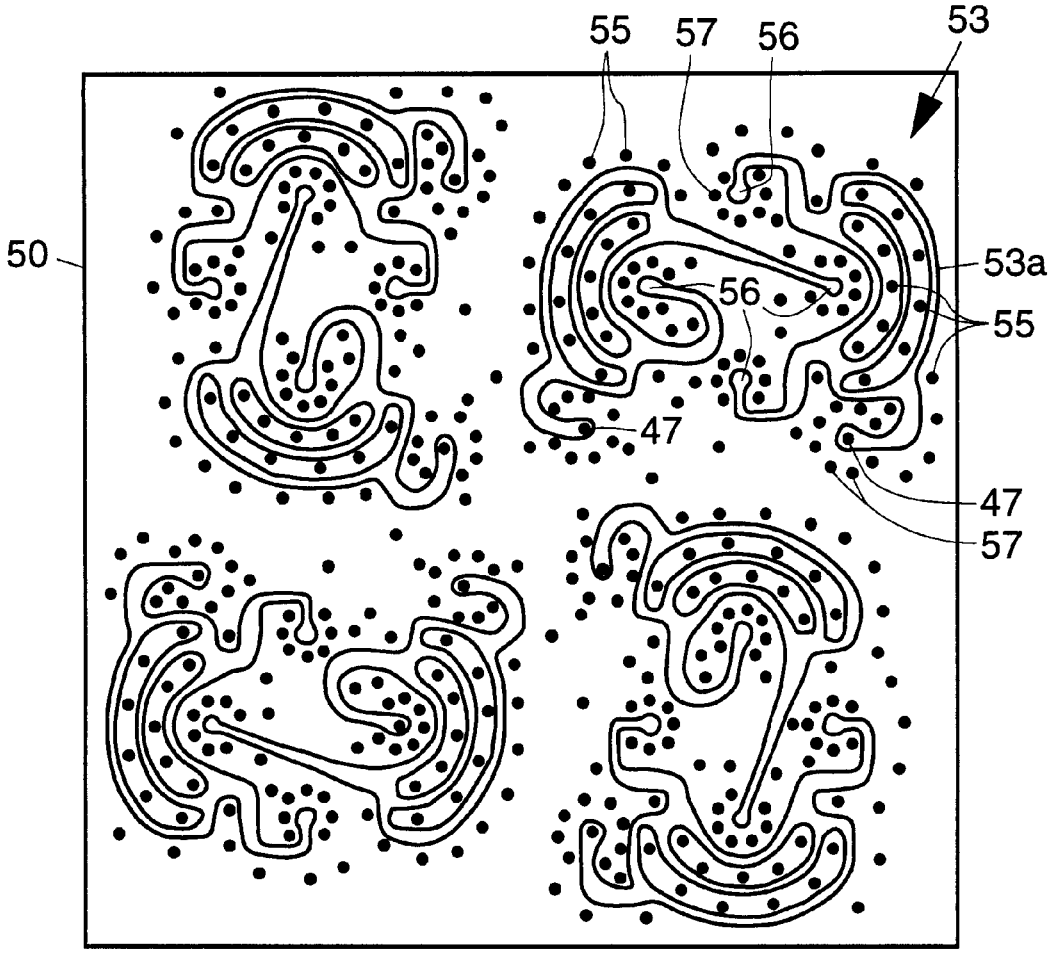
FIG. 5*a* shows a plan view of the balun layer and modified ratrace 180° hybrid coupler circuit used in the integrated radiator tile of FIG. 1.

FIG. 5 illustrates the radiator feed layout for the stacked disc radiator 80 used in the integrated radiator tile 10 of FIG. 1. FIG. 5 contains superimposed internal circuit layers. The radiator feed layout has a plurality of transmit ports 81 and a plurality of receive ports 82 that are coupled to the coaxial connectors 23. The locations of the probes 63 below the active radiators 64 and parasitic patches 66 are shown. The configuration of the modified ratrace 180° hybrid coupler circuit 53 is shown in FIG. 5. The configurations of the bottom and top stripline circuits 32, 33 of the coupling circuit layer 30 are shown in FIG. 5. The locations of 180° ratrace to 90° coupler transitions comprising the metallized vias 47 are shown in FIG. 5. All circuits (180° hybrid, 90° coupler, and the vertical RF transitions) are designed for wideband performance. For clarity, FIG. 5*a* shows a plan view of the balun layer 50 and modified ratrace 180° hybrid coupler circuit 53.

The integrated radiator tile 10 is configured as a 2 by 2 element subarray that is designed to interface directly with transmit/receive (T/R) module tiles. The overall thickness of the integrated radiator tile 10 is approximately 0.4" which also includes a mechanical support layer (not shown) behind the multi-layer stripline feed. The radiator layers make up about half (~0.2") of the overall thickness of the integrated radiator tile 10. Eight commercial SSMP coaxial connectors 23 are connected on the back side of the integrated radiator tile 10 that connect to outputs of the T/R module tiles (which also use mating SSMP connectors). There are two connectors 23 for each stacked-disc radiator 80 that provide for separate transmit and receive paths. The radome 70 seals the aperture from the environment.

The modified ratrace coupler 53*a* serves as a balun for the stacked-disc radiator 80, providing the necessary 180° phase difference between the pair of probes 63. The modified ratrace couplers 53*a* are configured using additional traces that increase the overall bandwidth of the conventional ratrace coupler by about 150 percent. The modification involves adding an additional loop to the conventional ratrace ring hybrid geometry to increase bandwidth operation. Two of the 180° hybrid coupler circuits 53 are packaged on a single layer stripline board 50 under each stacked-disc radiator 80. Since the radiator tile contains four radiators, FIG. 5*a* shows that the 180° layer 50 for the 2×2 tile has a total of 8 ratrace couplers. The two outputs of the 180° hybrid circuits transition to 90° hybrid circuits 32, 33 located on the lower coupler stripline circuit board 30.

FIG. 6 shows a waveguide simulator measurement for the integrated radiator tile 10 of FIG. 1. A waveguide simulator was used to test the integrated radiator tile 10 and 180° hybrid coupler circuits 53, which produced the test results shown in FIG. 6. The two traces shown in FIG. 6 correspond to the two orthogonal orientations of the radiator tile 10. These results agree well with predicted performance. The best performance was obtained between 7 and 9 GHz (~15 dB return loss) with scan performance degrading at higher frequencies as designed due of the large lattice spacing selected for this application.

Figure 7:
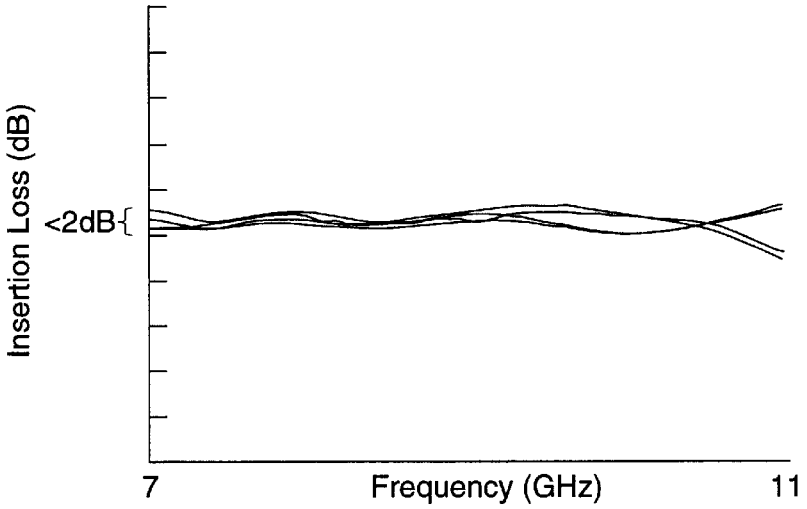
FIG. 7 shows insertion loss resulting from the combined 90° and 180° hybrid circuits shown in FIG. 3.
Figure 8:
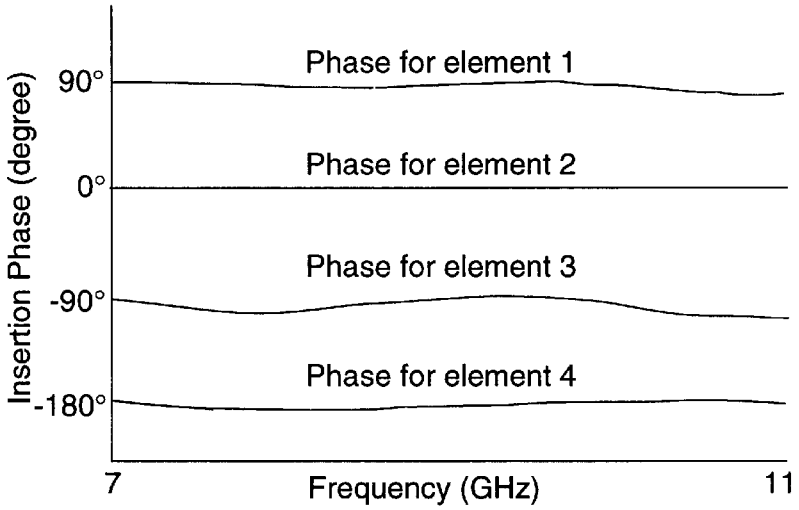
FIG. 8 shows insertion phase resulting from the combined 90° and 180° hybrid circuits shown in FIG. 3.

FIG. 7 shows insertion loss resulting from the combined 90° and 180° hybrid circuits 41, 50 shown in FIG. 3. FIG. 8 shows the measured insertion phase resulting from the combined 90° and 180° hybrid circuits 41, 50 shown in FIG. 3. Both figures show 4 traces, which correspond to the four outputs of the combined circuit (assume input at one via 24*a* and output at four vias 56 of each radiator. The measured data shows excellent performance-no worse than 6° from ideal over the entire frequency bandwidth except at the band edges, where it degrades to about 14°.

The combined circuits provided both senses of circular polarization. The four traces shown in FIG. 7 tracked each other very well. The two inputs of the combined circuits (same as the two inputs of the 90° hybrid circuit 30) match with the two outputs of the T/R module for each radiating element. The four outputs of the combined circuits (same as the four outputs of the 180° hybrid circuit) were transitioned to the stacked-disc radiator 80 through the four metal probes 63 (vertical RF interconnects). The measured 1.6 dB loss for the test circuits was close to expected considering that relatively hard, lossy material (Rogers R4003) was used for the stripline boards 30, 50, and there were three vertical RF transitions 24, 47, 56 in the multi-layer circuit.

Figure 9:
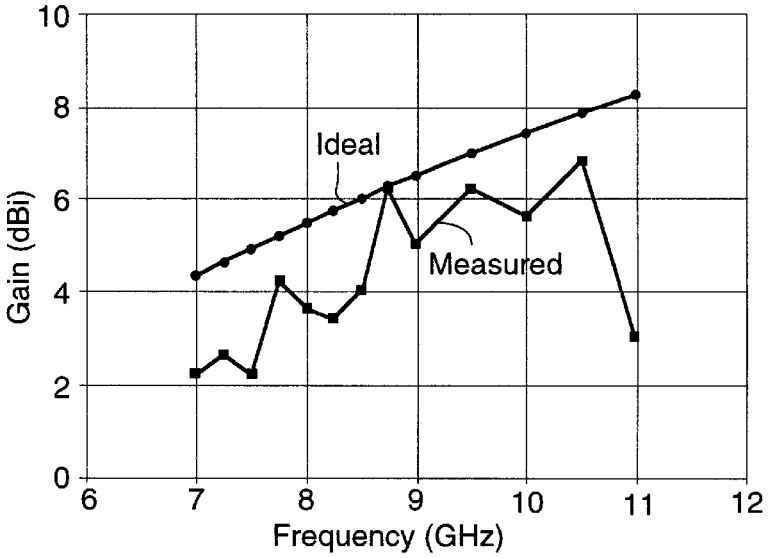
FIG. 9 shows the measured embedded element gain of the integrated radiator tile of FIG. 1.

FIG. 9 shows the measured element embedded gain of the integrated radiator tile of FIG. 1. The measured embedded element gain is consistent with predicted values except for the large ripples due to small aperture size. The measured gain was roughly 2 dB lower than area gain due to the mismatch and line loss.

Figure 10A:
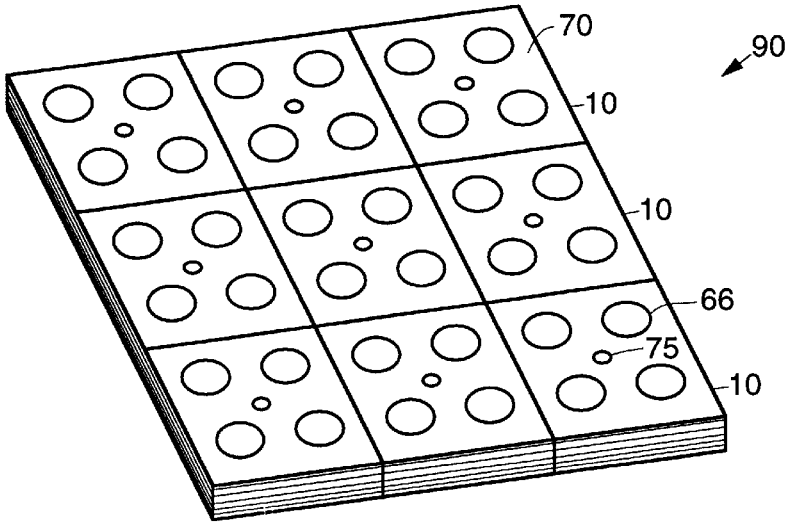
FIG. 10*a* shows a 6 by 6 test antenna array constructed using a plurality of integrated radiator tiles.
Figure 10B:
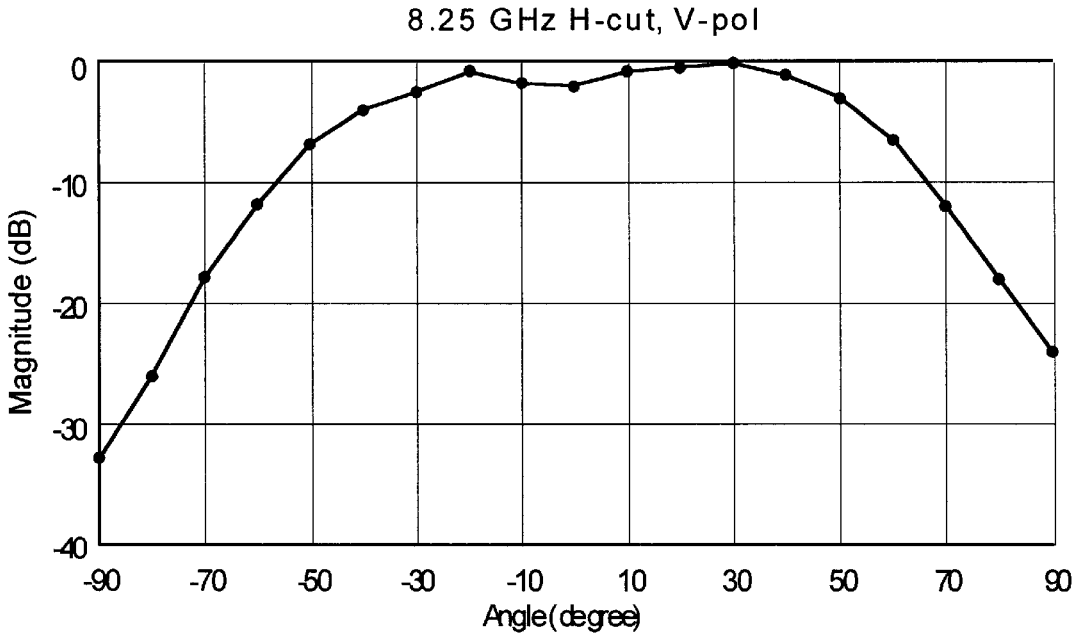
FIG. 10*b* shows the measured element pattern of a 6 by 6 integrated radiator tile test antenna array.

A plurality of the integrated radiator tiles 10 described above may be readily secured together to form an antenna array. FIG. 10*a* shows an exemplary 6 by 6 test antenna array 90 constructed using a plurality of integrated radiator tiles 10. FIG. 10*b* shows the measured embedded element pattern of a 6 by 6 test antenna array 90 built using integrated radiator tiles 10 to validate aperture performance. The integrated radiator tiles 10 are designed to operate from 7 GHz to 11 GHz. The embedded element pattern held up well to 45° in all plane cuts up to nearly 9 GHz which is consistent with predictions. Thus, the predicted and measured performance of the planar, low-profile integrated radiator tile 10 of the present invention meet requirements of conformal phased array applications for radar and satellite communication systems such as those developed by the assignee of the present invention.

The parasitic radiator 66 is parasitically excited, and is not directly fed by the probes 63. In the presence of mutual coupling, the lower active radiator 64 is tuned to operate at a lower frequency band, while the parasitic radiator 66 is tuned to higher frequencies. Consequently, the operational bandwidth of the integrated radiator tile 10 is extended to encompass the lower and higher frequency bands. The two pairs of probes 63 provide dual-linear polarization and circular polarization capability. More particularly, the polarization of the integrated radiator tile 10 may be single linear polarization, dual linear polarization, or circular polarization depending on whether a single pair or two pairs of probes 63 are excited.

Parameters for an exemplary embodiment of the integrated radiator tile are as follows. The spacing between each of the stacked-disc radiators 80 may be 0.78" in a rectangular lattice. The dielectric puck 62 may have a dielectric constant of 3.27, a diameter of 0.535", and thickness of 0.12". The dielectric material 61 may surround puck 62 and have a dielectric constant of about 1.70, and a thickness of 0.061" over puck 62. The lower active disc radiator 64 may have a diameter of 0.535", and the upper parasitic radiator 66 may have a diameter of 0.320". The radome may have a average dielectric constant of 2.56, and a thickness of 0.060". The separation between each pair of probes 63 may be 0.330".

It is to be understood that the feed circuits and the number of circuit layers in the integrated radiator tile 10 may differ from the exemplary embodiment disclosed herein, depending on the application, i.e., whether it is linear or circular polarized, whether the stacked disk radiator 80 can be block-fed, or whether the design requires an external coaxial connector, for example. The stacked-disc radiator 80 used in the integrated radiator tile 10 can provide an octave bandwidth. The feed circuits disclosed herein that drive the stacked-disc radiator 80 provide the means to achieve this octave bandwidth. The integrated radiator tile 10 uses wideband feed circuits that are compactly constructed and that are integrated with the stacked-disc radiator 80 in an low-cost package. The bandwidth of the feed circuits and vertical RF transitions essentially determine the overall bandwidth performance of the integrated radiator tile 10. Integrated radiator tiles 10 have been constructed that can cover 45% bandwidth.

Thus, low profile integrated radiator tiles comprising stacked disc radiators for use in phased array antennas has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An integrated radiator tile for use in a phased array antenna, comprising:

a bottom dielectric layer having a ground plane disposed on an exposed surface, and having first and second via transitions formed through the bottom dielectric layer;

a coupling circuit layer adjacent to the bottom dielectric layer comprising 90° hybrid coupler circuits respectively coupled to the first and second via transitions;

a balun layer adjacent to the coupling circuit layer comprising lower and upper ground planes formed on opposite surfaces, 180° hybrid coupler circuits, a plurality of RF transitions selectively connected between the 180° hybrid coupler circuits and the 90° hybrid coupler circuits, and a plurality of radiator to RF transitions coupled to the 180° hybrid coupler circuits;

a plurality of grounding vias interconnecting the lower and upper ground planes of the balun layer, a plurality of grounding vias interconnecting the lower ground plane of the balun layer and the ground plane of the bottom dielectric layer, and a plurality of grounding vias surrounding each of the radiator to RF transitions;

a stacked disk radiator adjacent to the balun layer comprising a dielectric puck having an active radiator formed on an upper surface, an upper dielectric layer adjacent to the active radiator, a parasitic radiator adjacent to the upper dielectric layer, and a pair of excitation probes coupled between the radiator to RF transitions and the active radiator.

2. The integrated radiator tile of claim 1 further comprising a radome covering the parasitic radiator and the upper dielectric layer.

3. The integrated radiator tile of claim 1 further comprising first and second coaxial connectors coupled to the ground plane and having center pins coupled to the first and second transitions.

4. The integrated radiator tile of claim 1 further comprising connectorless coax-like structures coupled to the ground plane and to the first and second transitions.

5. The integrated radiator tile of claim 1 wherein the 180° hybrid coupler circuits comprises modified ratrace couplers.

6. The integrated radiator tile of claim 1 further comprising a plurality of vias coupled between the upper ground plane of the balun layer and the active radiator, and disposed around the excitation probes.

7. The integrated radiator tile of claim 1 wherein the upper dielectric layer surrounds the dielectric puck, and the dielectric puck is disposed in a recess formed in the upper dielectric layer.

8. The integrated radiator tile of claim 1 further comprising a flat foam spacer disposed between dielectric puck and the radome.

9. The integrated radiator tile of claim 7 wherein the upper dielectric layer surrounding the dielectric puck comprises a dielectric material having a dielectric constant that is equal to that of the dielectric puck.

10. The integrated radiator tile of claim 1 wherein the dielectric puck is fully surrounded by air dielectric.

11. The integrated radiator tile of claim 1 wherein the dielectric puck is partially surrounded by air dielectric.

12. The integrated radiator tile of claim 1 wherein the coupling circuit layer and the balun layer produce both senses of circular polarization.

13. The integrated radiator tile of claim 1 wherein the coupling circuit layer and the balun layer produce dual-linear polarization.

14. The integrated radiator tile of claim 1 wherein the upper dielectric layer comprises a relatively low dielectric constant material relative to the dielectric constant of the balun layer.

15. The integrated radiator tile of claim 1 wherein the dielectric materials comprising the dielectric puck, the balun layer, and the 90° coupling circuit layer similar coefficients of thermal expansion.

16. An antenna comprising:

a plurality of integrated radiator tiles abutting each other that form an array, each integrated radiator tile comprising:

a bottom dielectric layer having a ground plane disposed on an exposed surface, and having first and second via transitions formed through the bottom dielectric layer, a coupling circuit layer adjacent to the bottom dielectric layer comprising 90° hybrid coupler circuits respectively coupled to the first and second via transitions;

a balun layer adjacent to the coupling circuit layer comprising lower and upper ground planes formed on opposite surfaces, 180° hybrid coupler circuits, a plurality of RF transitions selectively connected between the 180° hybrid coupler circuits and the 90° hybrid coupler circuits, and a plurality of radiator to RF transitions coupled to the 180° hybrid coupler circuits;

a plurality of grounding vias interconnecting the lower and upper ground planes of the balun layer, a plurality of grounding vias interconnecting the lower ground plane of the balun layer and the ground plane of the bottom dielectric layer, and a plurality of grounding vias surrounding each of the radiator to RF transitions;

a stacked disk radiator adjacent to the balun layer comprising a dielectric puck having an active radiator formed on an upper surface, an upper dielectric layer adjacent to the active radiator, a parasitic radiator adjacent to the upper dielectric layer, and a pair of excitation probes coupled between the radiator to RF transitions and the active radiator.

17. The antenna of claim 16 further comprising a radome covering the parasitic radiator and the upper dielectric layer.

18. The antenna of claim 16 further comprising first and second coaxial connectors coupled to the ground plane and having center pins coupled to the first and second transitions.

19. The antenna of claim 16 further comprising connectorless coax-like structures coupled to the ground plane and to the first and second transitions.

20. The antenna of claim 16 wherein the coupling circuit layer and the balun layer selectively produce both senses of circular polarization or dual-linear polarization.

* * * * *